United States Patent [19]

Kerekes

[11] 3,967,871

[45] July 6, 1976

[54] PROCESS FOR MANUFACTURING TUBELESS VACUUM ELECTRIC DISCHARGE LAMPS

[75] Inventor: Bela Kerekes, Budapest, Hungary

[73] Assignee: Egyesult Izzolampa Es Villamossagi Resvenytarsasag, Budapest, Hungary

[22] Filed: June 30, 1975

[21] Appl. No.: 591,503

Related U.S. Application Data

[62] Division of Ser. No. 366,741, June 4, 1973, abandoned.

[30] Foreign Application Priority Data

June 23, 1972 Hungary ..... EE 2038

[52] U.S. Cl. ..... 316/4; 316/3; 316/30

[51] Int. Cl.[2] ..... H01J 9/395

[58] Field of Search ..... 316/1, 17, 18, 19, 20, 316/21, 34, 5, 8, 10, 12, 30

[56] References Cited

UNITED STATES PATENTS

| | | | |
|---|---|---|---|
| 3,609,437 | 9/1971 | Tol et al. | 316/17 |
| 3,628,846 | 12/1971 | Cartorillo | 316/17 |
| 3,645,599 | 2/1972 | Van Bragt | 316/30 |
| 3,650,593 | 3/1972 | Kerekes | 316/4 |

*Primary Examiner*—Roy Lake
*Assistant Examiner*—J. W. Davie

[57] ABSTRACT

Manufacturing tubeless executed high pressure ceramic or monocrystalline vacuum metal vapor lamps. The substance introduced into the discharge tube is degassed by heating the tube at least once before sealing it finally. The equipment employed in carrying out the method preferably comprises two heaters to be accommodated at the ends of the discharge tube, the heat zone of which is about 1/3 of the discharge tube length. The additives are placed into the sealed end of the discharge tube, and while heated, the tube is pumped on the other end. The additives precipitate on the colder wall parts of the discharge tube, but at the same time it is also freed from its gas content. Thereafter the precipitate is evaporated by heat treatment. This double evaporation results in a high grade degassing of the substance. Afterwards the opposite end of the discharge tube is finally sealed.

6 Claims, 1 Drawing Figure

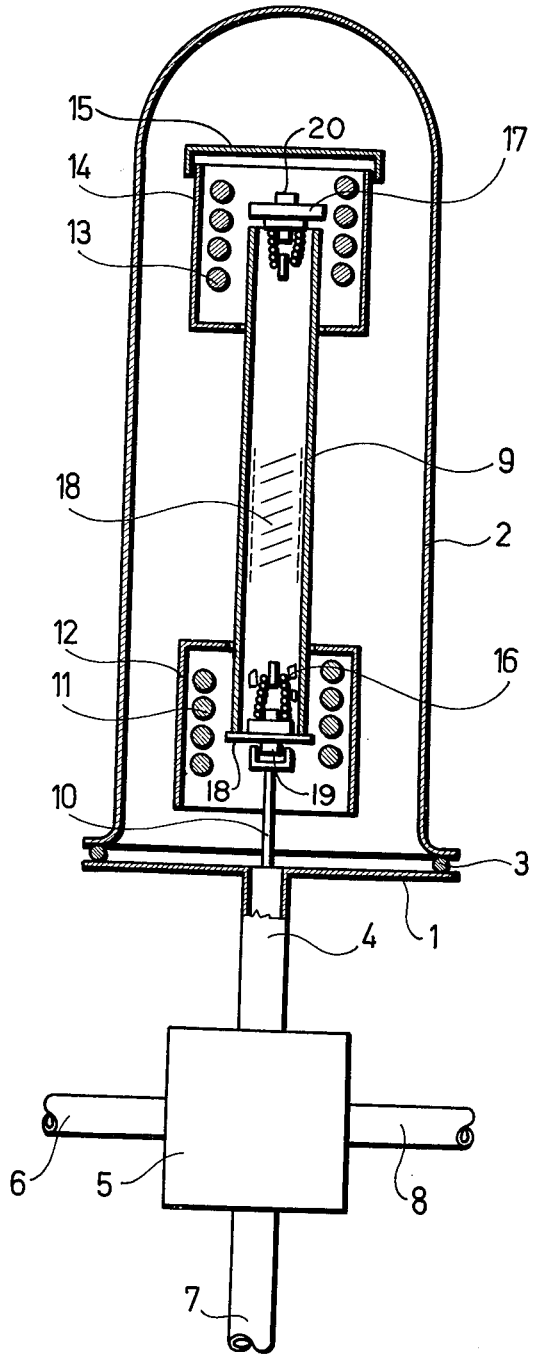
15
20
17
14
13
9
18
2
12
16
11
18
19
10
3
4
1
6
5
8
7

PROCESS FOR MANUFACTURING TUBELESS VACUUM ELECTRIC DISCHARGE LAMPS

This is a Division, of application Ser. No. 366,741 filed June 4, 1973, now abandoned.

This invention relates to a process of manufacturing devoid of suction tubes electric discharge lamps, otherwise termed "suction tubeless electric discharge lamps", containing metal and/or metallic salt vapors.

Constructions having no suction tubes are known mainly in the field of gas discharge lamps with ceramic or crystalline bulbs. The advantages of constructions without suction tubes are not dealt with here; instead, reference is made to Hungarian Patent No. 157,478.

In another known construction, although a tube is used for the vacuum tight sealing of the bulb, this tube however, has the object of leading in current on the one hand, and, on the other, advantages created by its elastic behavior are utilized, rather than the possibility of evacuating and filling the bulb with discharge substances. Therefore from the point of view of the manufacturing process this construction is to be regarded as one which does not employ a suction tube. Such a construction of lamps and the manufacturing procedure connected with it, are described e.g. in British Patent No. 1,205,871.

The problem of manufacturing vacuum techical products, such as incandescent lamps, electron tubes, etc. without suction tubes is of old origin. The complexity of the manufacturing process depends on the filling of the lamp. If e.g. the bulb has only to be evacuated, then a gap is left in an appropriate place on the bulb, the bulb is placed in a surrounding under vacuum, and by letting some sealing material flow into the gap, this after cooling down closes up the gap and so the bulb remains under vacuum.

Greater care should be taken when, for example, the bulb is to be filled with mercury, because in the mentioned sealing procedure part of the bulb should be left cold, to give to the mercury a chance to precipitate, because otherwise it would evaporate from the bulb during the sealing process.

The situation is still more complex with sodium filled lamps. Sodium oxidizes easily in the air; therefore the above-cited British Patent suggests the rinsing of the bulb of the lamp by an inert gas before filling it with sodium.

Gas discharge lamps have, however, requirements which can easily be met with constructions having suction tubes; these problems have not been solved up to now by known processes for manufacturing discharge lamps having no suction tubes. One problem is e.g. the evacuation or dehydration of the discharge substance, such as sodium or mercury placed into the bulb. To this also the British Patent does not give any possibility.

We have found, however, that the life of gas discharge lamps is affected very unfavorably by the difficult to be controlled amount and quality of gas introduced in the constructions without suction tubes by solid external substances (Na, Hg, different metallic salts, etc.), and also when the previous rinsing has been carried out.

It should be noted that such a problem does not exist on constructions with a suction tube, because in the manufacturing process connected with such lamps the gas discharge substances after vacuum evaporation get into the discharge space through the suction tube, and degasing of the substances is effected automatically during this operation.

There are discharge substances, such as different metallic salts (e.g. metal halogenides), which are strongly hygroscopic or which have crystal water in a bound form. The application of these in lamps having no suction tube, in manufacturing processes known up to now leads not only to the reduction of life of the lamps, but is impossible directly.

The present invention has among its objects the provision of a process by which the abovedescribed drawbacks may be eliminated.

The objects and features of the invention are fully explained in the specification.

The essence of the process according to the invention is to heat at least once the discharge substances placed into the bulb, before its final sealing. The equipment preferably employed in carrying out the method according to the invention to achieve such purpose contains two heaters at the ends of the discharge tube, the heating zones of which do not extend over more than 1/3 of the length of the discharge tube.

The process of manufacturing tubeless electrical gas discharge lamps, mainly with ceramic or crystalline bulbs, is characterized by filling into the bulb closed at one end by a closure member the discharging substances (Hg, Na, metallic salts, etc.), the other closure member provided previously with sealing material being fitted into the other end of the tube. The process is carried out in such manner that the external materials arrive in the sealed end of the tube by the action of their own weight; afterward the sealed end of the tube is heated in vacuum, and the discharge substances are degased or evaporated. Meanwhile the remaining part of the tube, expediently 2/3 of the length is maintained so cold that the vapors of the discharge substance can precipitate, and the end of the tube formerly heated is cooled to a temperature so low that upon the action of the heat originated by the sealing operation of the second closure member, the evaporated discharge substances can again precipitate there; thereafter, by local heating the other tube end and also the second closure member are sealed.

In the drawing:

The single FIGURE is a view partially, in side elevation and partially in vertical section of an apparatus for carrying out the method in accordance with the invention for manufacturing tubeless electrical discharge lamps.

The illustrative apparatus for carrying out the process of the invention includes a plate-like support for a bell shaped hood, the space within the hood being connected by a pipe connected to a distributing device set up in a known way. At least three pipes are attached to the distributing device, one of such pipes being connected to the atmosphere, one being connected to vacuum, and the third being connected to a rare gas atmosphere. In the space confined by the hood and the plate there are two heaters with their medians at a distance corresponding to the length of the bulb or tube of the lamp to be sealed, expediently surrounded by heat reflecting surfaces; the dimension of the heaters measured in longitudinal direction of the tube to be sealed does not exceed 1/3 of it.

The construction of the equipment preferably employed in carrying out the method according to the invention will be better understood by reference to drawing.

On a polished metal plate there is placed a glass hood 2 also with a polished front surface. Between them is a vacuum rubber gasket 3, to effect a vacuum tight sealing. The space confined by the hood and the plate discharges through pipe 4 into a distributing system or valve 5, built in a known way, so that by hand or automatic control the space in the hood can be selectively connected to one of the pipes 6, 7 or 8 which are joined to system 5. Pipe 6 is connected to a rare gas bottle (not shown), by the gas of which the discharge tube is to be filled. Pipe 7 is connected with a pumping system (not shown) for evacuating the hood. Through pipe 8 air can be introduced into the hood. Discharge tube 9, which is to be filled by discharge substances according to the invention, is placed on a rod-like support 10 within the bulb. The lower end of tube or bulb 9 is surrounded by a relatively short electrical resistance heating spiral 11. The heating spiral 11 is fed by current through a bushing fixed in plate 1, this detail, however, is not shown on the drawing. The efficiency of the heating spiral 11 is improved by the glossy surface of reflector 12. The upper end of the discharge bulb, in a manner similar to the lower end, is surrounded by a heating spiral 13 and a reflector 14, 15.

The heating zone of the heaters 11, 13 is expediently not longer than 1/3 of the discharge bulb length.

The manufacturing process according to the invention consists in placing the discharge bulb with one end already sealed (closed at one end by a closure member 18 which has a first electrode 19) into the support 10, and discharge substances 16, e.g. mercury, sodium, different metallic salts are filled into the tube. Hereafter the other closure member 17 having an electrode 20 is fitted into the upper end of the tube onto which vitreous sealing material has been fused previously. After putting on the reflector cover 15 and hood 2, the hood is connected by means of the switching device 5 to pipe 7, through which the bulb will be evacuated. When terminal vacuum is reached, the lower bulb end is heated by inserting the heating spiral 11. The action of spiral 11 causes the discharge substances placed there to be degassed, or depending on their composition, melted, evaporated or sublimed.

During this operation gases or vapors of discharge substances will precipitate on the middle of the bulb 9, because it is still cold. This precipitate is designated in the drawing as 18.

After having degassed the discharge substances, the lower end of the bulb 9 is cooled down. Now the inserting of upper spiral 13 follows. By the action of spiral 13 the upper end of the bulb 9 and the closure member are heated, preferably to a temperature of 100° to 200°C lower than the melting point of the sealing material.

The upper heat from spiral 13 spreads meanwhile towards the middle of the bulb; by such action the substances precipitated there again evaporate, and precipitate now for a second time on the cold lower end of the bulb. This double distillation, which is an essential part of the process according to the invention, results in a very high grade degassing of the discharge substances, and is thus very important from the point of view of the stability of electrical parameters and life of the discharge lamp.

If hereafter it is intended to fill the bulb by gas, pipe 7 will be closed by distributing device 5 and the hood 2 will be connected to pipe 6. The pressure in the bulb is raised to a level corresponding to that which is intended to be established within the discharge bulb 9, e.g. in so-called high pressure sodium vapor lamps with ceramic bulbs, 20 to 30 Hg, mm., and the gas used may be, for example argon or xenon.

After having filled in the gas, the temperature of the upper bulb end is raised a little above the melting point of the sealing material. The quality of the sealing material is not material with respect to the process of the invention, and it is noted only that for an alumina bulb a 50 percent solution of e.g. $Al_2O_3$ and CaO is suitable, the soldering temperature of which is about 1450°C.

On reaching the melting point temperature of the sealing material, the closure member 17 sinks by reason of its own weight into the end of the discharge tube and seals it. As rare gas has been introduced into the bulb before the fusing of the solder, it also penetrated through the gap between the closure member and the tube into the interior of the discharge tube, and so it also remains there after sealing together the closure member and the tube.

In order to achieve the described degassing, by distillation of the discharge substances according to the invention, the equipment of the invention, is designed in such a manner as to limit longitudinally the heating of the bulb ends. A suitable means for achieving this is correct dimensioning of the diameter and the length of heaters and the heat reflecting system 12, 14 and 15 as shown in the drawing. Geometrical sizing of these parts depends on the length and diameter of the discharge bulb and on the melting point of the sealing material. This dimensioning presents no problem to an expert familiar with the process and equipment according to the invention.

The conditions of sizing heaters and reflectors, taking into consideration the real lengths of discharge lamps, are also to be satisfied when several tubes are simultaneously filled and sealed. The basic idea of the process and equipment preferably employed in carrying out the process according to the invention is unchanged.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. A process of manufacturing an electrical metal vapor discharge lamp with an elongated bulb and without a suction tube, comprising the steps of:

placing said elongated bulb in a chamber;

sealing a first end closure member and electrode assembly to a first end of said bulb;

introducing a discharge substance through a second end of said bulb;

mounting a second closure member provided with sealing material and an electrode assembly into said second end of said bulb;

producing a vacuum pressure in said chamber;

mounting a second closure member provided with sealing material and an electrode assembly into said second end of said bulb;

heating said first end of said bulb under said vacuum pressure so as to evaporate said discharge substance, while maintaining a remaining portion of the bulb between said ends at a lower temperature than that of said heated first end of said bulb so that the vapors of the evaporated discharge substance will precipitate on said remaining portion and said second end;

heating said second end of said bulb so as to evaporate said discharge substance, while maintaining said remaining portion at a lower temperature than that of said heated second end of said bulb so that the vapors of the evaporated discharge substance will precipitate on said remaining portion;

sealing said second closure member to said bulb by locally heating said second end of said bulb.

2. A process according to claim 1, wherein the bulb of the lamp is made of a ceramic material.

3. A process according to claim 1, wherein the bulb of the lamp is made of a crystalline material.

4. A process according to claim 1, wherein the discharging substance is chosen from the group consisting of mercury, sodium, and metallic salts.

5. A process according to claim 1, wherein during the sealing of the second closure member the bulb is maintained in a rare gas atomsphere in said chamber at melting point of the sealing material, and afterwards the temperature of said second end of said bulb is raised to a value necessary for sealing the closure member vacuum tightly.

6. A process according to claim 1, wherein the process is carried out with a plurality of bulbs at the same time.

* * * * *